United States Patent [19]

Grisebach

[11] 4,112,680

[45] * Sep. 12, 1978

[54] CONTROL SYSTEMS AND ARRANGEMENTS FOR MINERAL MINING INSTALLATIONS

[75] Inventor: Hans Theodor Grisebach, Unna, Fed. Rep. of Germany

[73] Assignee: Gewerkschaft Eisenhutte Westfalia, Lunen, Fed. Rep. of Germany

[ * ] Notice: The portion of the term of this patent subsequent to Jun. 29, 1993, has been disclaimed.

[21] Appl. No.: 766,069

[22] Filed: Feb. 7, 1977

Related U.S. Application Data

[60] Continuation-in-part of Ser. No. 632,191, Nov. 17, 1975, Pat. No. 4,046,058, which is a division of Ser. No. 423,483, Dec. 10, 1973, Pat. No. 3,965,797.

[51] Int. Cl.[2] ..... F15B 7/02

[52] U.S. Cl. ..... 60/538; 60/547; 60/591; 60/593; 91/40; 91/411 R

[58] Field of Search ..... 91/32, 426, 429, 433, 91/461, 167 R, 304, 35, 2, 14, 309, 40, 411 R; 60/574, 581, 387, 538, 547, 591, 593

[56] References Cited

U.S. PATENT DOCUMENTS

| | | | |
|---|---|---|---|
| 3,965,797 | 6/1976 | Grisebach | 91/32 |
| 4,046,058 | 9/1977 | Grisebach | 91/32 |

*Primary Examiner*—Martin P. Schwadron
*Assistant Examiner*—Abraham Hershkovitz
*Attorney, Agent, or Firm*—Thompson, Birch, Gauthier & Samuels

[57] ABSTRACT

In a mineral mining installation employing a series of shifting rams for advancing a scraper-chain conveyor provided with a guide for a mining machine, a control system is used to provide a succession of small fluid doses to the rams. Control signals, preferably remotely generated, serve to actuate local valves to cause a selected one or group of piston and cylinder metering devices to alternately accept and expel pressure fluid from a working chamber. In this way a pre-determined volume of pressure fluid can be transferred to one or more of the rams to effect the shifting advancement. This volume of pressure fluid is made up from a succession of small fluid doses each a small fraction of the desired shifting distance so that by repeated cycles of the device or devices the ram or rams associated therewith can extend in fine defined increments.

12 Claims, 7 Drawing Figures

CONTROL SYSTEMS AND ARRANGEMENTS FOR MINERAL MINING INSTALLATIONS

CROSS REFERENCE TO RELATED APPLICATIONS

The present application is a continuation-in-part of U.S. Pat. application Ser. No. 632,191 filed Nov. 17, 1975, which issued as U.S. Pat. No. 4,046,058 on Sept. 6, 1977, which was a division of U.S. Pat. application Ser. No. 423,483, filed Dec. 10, 1973, which issued as U.S. Pat. No. 3,965,797 on June 29, 1976.

BACKGROUND TO THE INVENTION

The present invention relates to control arrangements for use in mineral mining installations.

In mineral mining installations employing a mineral winning machine movable along a guide, usually provided on one side of a longwall scraper-chain conveyor, it is known to provide a control system for operating shifting rams to cause the guide, and hence the machine, to be advanced towards the mineral face. The guide is usually composed of sections and it is conventional to cause the guide sections to be advanced successively and incrementally by the full cutting depth of the machine after the latter has passed over the guide section in question. The control system may employ a central conrol station which causes each of the shifting rams, or groups of the rams, to be charged with pressure fluid when shifting is to take place. It is also known to employ devices which provide quantitative control by metering certain quantities of pressure fluid to the rams. In this way the advancement effected by each ram can be controlled so that the guide is advanced uniformly over its length. Usually the metering devices are provided with some form of adjustment to vary the quantity of pressure fluid supplied to the associated ram or rams. In general, the devices are of comparatively large dimensions and supply a volumetric quantity of fluid commensurate with the total capacity of each of the rams. Moreover, the provision of individual adjustment for each such device increases the overall cost of the control system and involves considerable time in setting up and monitoring the operation of the system.

A general object of the present invention is to provide improved forms of control arrangements for use in the aforementioned application.

SUMMARY OF THE INVENTION

According to one aspect of the invention there is provided an improved control system or arrangement for operating the rams and effecting fine control of the displacement of mining apparatus. The system may comprise pressure fluid supply means for supplying fluid used for operating the rams, a plurality of fluid-apportioning devices each allocated to at least one of the rams and being composed of a piston and cylinder unit with a working chamber, automatic means for alternately and cyclically establishing connection between the working chamber of the unit and the pressure fluid supply means and between the working chamber of the unit and the working chamber of said at least one ram and for operating the piston of said unit to alternately charge the working chamber of said unit with fluid and to expel the fluid to the associated ram in predetermined non-variable quantities in successive doses, each dose corresponding to the expelling displacement of the piston of the device and to a single connecting cycle of the connecting means and moving the apparatus through a fraction of the pre-determined distance, means for generating separate control signals and actuating means energized by the control signals to cause the connecting means to perform a number of cycles to transfer to a succession of fluid doses to the ram in dependence on the control signals and the predetermined distance.

In another form the system may comprise pressure fluid supply means for supplying fluid used for operating the rams, a plurality of fluid-apportioning devices each allocated to at least one of the rams and being composed of a piston and cylinder unit with first and second working chambers, a first piston associated with the first chamber, a second piston connected to move with the first piston and associated with the second chamber, the second piston having a larger working area than the first piston, and a means biasing the first and second piston to tend to open the first chamber and close the second chamber, non-return valves permitting connection between the first chamber of the unit and the pressure fluid supply means when the biasing means of the unit opens the first chamber to accept pressure fluid and permitting connection between the working chamber of said at least one ram and the first chamber of the unit when the first piston is displaced to expel the fluid to the associated ram, whereby displacement of the piston under the action of the biasing means and in the opposite expelling sense will cause pre-determined nonvariable quantities of fluid to be supplied to said ram in successive doses, each dose corresponding to the expelling displacement of the first piston of the unit and moving the apparatus through a fraction of the predetermined distance and means for generating separate pressure signals fed to the second chamber of the unit to act on the second piston and cause the first piston to perform its expelling displacement to transfer a succession of fluid doses to the ram in dependence on the number of pressure signals and the predetermined distance.

In accordance with the invention the apportioning devices can be of comparatively small size and can be combined with the rams to form constructional units therewith. No individual adjustment of the devices is necessary since the maximum working volumes of the devices is far smaller than that of the rams and hence the devices can perform various numbers of operative cycles to control the total quantity of fluid supplied to their associated rams. Preferably the control signals are generated remotely to selectively initiate one or more of the devices. Each control signal, which may be electric or a pressure signal, may initiate one operative cycle of the device in question so that a series of signals can provide repetitive cycles with an accumulative quantity of fluid doses supplied to the ram associated therewith. If the depth of cut of a mining machine supported on a guide advanced by the shifting rams is say 6 cm., then in general the guide sections should be advanced by 6 cm., when the machine has passed and this would, in accordance with the invention, involve a number of operative cycles of the associated apportioning device to cause the ram to extend in increments.

It is possible to have two or more adjacent rams connected to one common apportioning device and this enables the number of devices required to be reduced. The volume of fluid supplied by the common device to the associated rams would still be considerably smaller than the total capacity of the rams and to the desired shifting step.

As described hereinafter the system can employ two-way connecting valves which control the desired apportioning devices in accordance with the control signals.

It is also possible for the apportioning devices to be controlled by stepping mechanisms, possibly with timing devices, each actuated by control signals but capable of causing the associated device or devices to automatically perform a number of operative cycles dependent on the signals received.

The invention may be understood more readily and various other features of the invention may become apparent, from consideration of the following description.

BRIEF DESCRIPTION OF THE DRAWINGS.

Embodiments of the invention will now be described, by way of examples only, with reference to accompanying drawings, wherein.

DESCRIPTION OF PREFERRED EMBODIMENTS

Figures 1, 2:
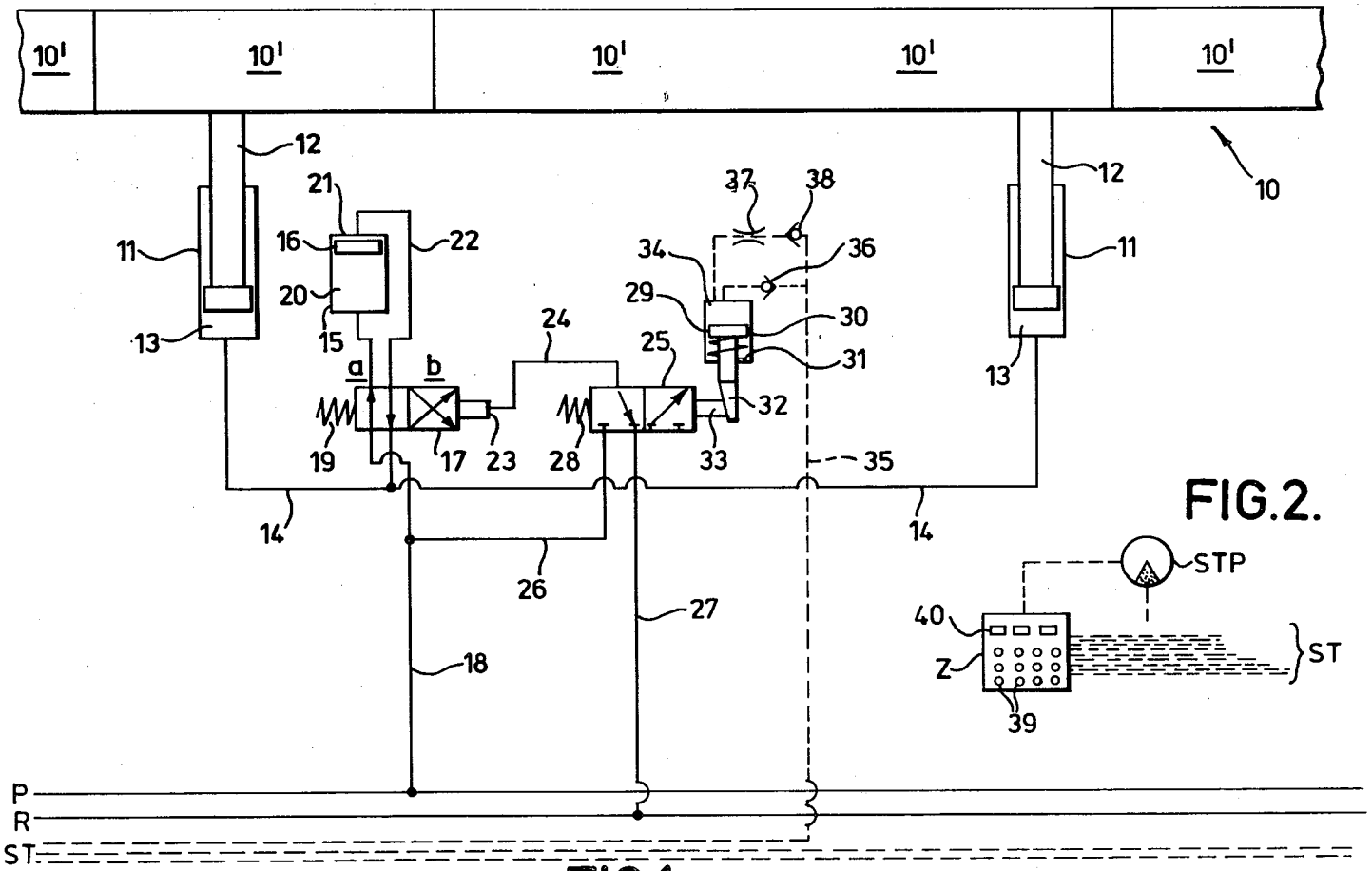
FIG. 1 is a block schematic diagram depicting part of a control system made in accordance with the invention.
FIG. 2 is a schematic representation of a control station for the system.

Referring initially to FIG. 1, the reference numeral 10 represents a longwall scraper-chain conveyor of a mineral mining installation, which conveyor is composed, in known manner of a series of channel sections 10' arranged end-to-end. A scraper-chain assembly (not shown) is circulated along these channel sections 10'. The channel sections 10' are inter-connected in such a manner as to allow a certain amount of angular mobility between the sections 10' about the longitudinal centre of the conveyor 10. Although not shown in the drawing, the conveyor 10 is provided with a guide means which supports and guides a mineral winning machine, more usually a coal plough, which is moved back and forth along the conveyor to win mineral from a mineral face. In order to advance the guide means, and hence the plough, toward the face to thereby follow up the mineral winning progress, a series of shifting rams 11 are disposed on the side of the conveyor 10 remote from the mineral face, i.e., on the goaf or stowage side. These rams 11 normally engage on movable roof support frames or units (not shown) which act as abutments for the shifting of the conveyor channel sections 10'. The operation of the rams 11 is usually controlled so that the conveyor channel sections 10' are progressively shifted so that the conveyor 10 performs the so-called incremental advance. Other types of apparatus can be shifted by the rams 11.

As shown in FIG. 1, the rams 11 have piston rods 12 which engage on the goaf or stowage side of the conveyor channel sections 10'. In the illustrated control system, the pressure chambers 13 of each two adjacent rams 11 are connected in common to a conduit 14 which serves to convey pressure fluid to these chambers 13. A piston and cylinder apportioning device 15 serves to meter a quantity of pressure fluid to these chambers 13 via the conduit 14 and the volume of the quantity of metered fluid supplied to each chamber 13 is several times smaller, i.e., a fraction of, the total capacity of the chamber 13 and of the shifting step to be performed. Hence, the distance by which the piston rods 12 are extended by the admission of the fluid into the chambers 13 is considerably smaller than the maximum stroke of the rods 12 and this distance is also made smaller than the shifting step, e.g., the cutting depth of the winning machine. As shown, the device 15 is in the form of a cylinder with a floating piston 16 movable in relation to two working chambers 21,20. A connecting valve 17 which can be set to either of the operating states or positions denoted *a* and *b* is connected via a conduit 18 to a pressure fluid supply conduit P which is usually laid along the entire mine working. The valve 17 is also connected via a conduit 22 to the working chamber 21 of the device 15 and via a conduit to the conduit 14. The other working chamber 20 of the device is also connected to the valve 17 via a conduit. The valve 17 has a spring 19 which biases the valve 17 into the state *a* in which the chamber 20 of the device 15 is connected to the conduit P via the conduit 18 and the chamber 21 is connected to the conduit 14 via the conduit 22. The valve 17 has a control piston 23 connected to a conduit 24 and when the piston 23 is subjected to pressure it opposes the force of the spring 19 to bring the valve 17 into the state *b* in which the chamber 20 of the device 15 is connected to the conduit 14 and the chamber 21 of the device 15 is connected to the conduit P. The valve 17 may employ a slide element to establish the various connections and this element may be acted upon directly at its ends by the spring 19 and the piston 23.

The conduit 24 is connected to a further valve 25. This actuating valve 25 is also connected via a conduit 26 to the conduit 18 and via a conduit 27 to a pressure fluid return conduit R which is, similar to the conduit P, normally laid along the entire mine working. The valve 25, which may also employ a slide element, is subjected to the action of a spring 28 which biases the valve in the operating state as shown where connection is established between the conduits 24,27, and the conduit 26 is blocked. The valve 25 has a control element or tappet 33 which, although analogous to the control piston 23 of the valve 17, is in contrast thereto, subjected to the mechanical action of a movable member in the form of an elongate cam 32. This cam 32 has an inclined face at the end of the tappet 33 so that as the cam 32 moves longitudinally, downwardly as depicted in FIG. 1, the tappet 33 can act on the slide element of the valve in opposition to the force of the spring 28 to bring the valve 25 into its other operating state where connection is established between the conduits 26, 24 whilst the conduit 27 is blocked. The cam 32 is disposed at the end of a piston rod of a piston and cylinder unit 29, 30. A spring 31 biases the piston 30 of the unit 29,30 towards a pressure chamber 34 to thereby allow the spring 28 to maintain the valve 25 in the state depicted in the drawing. The chamber 34 of the cylinder 29 is connected via a non-return valve 36 to a conduit 35 which leads to one of a group of control lines or conduits ST which convey pressure, preferably pneumatically, to the chamber 34. A throttle device 37 and a non-return valve 38, opening in the opposite direction to the valve 36, are connected in parallel to the valve 36. The conduits ST are also laid along the mine working and each conduit of the group ST is connected to a respective one of the units 29,30 to thereby, in this embodiment, control the operation of two adjacent rams 11. The conduits ST lead back to a central control station denoted Z in FIG. 2, whereat a plurality of switches 39,40, which can be manually operated, serve to establish connection between a selected one or more of the conduits of the group ST and a pressure source or pump STP. The switches 39 are allocated to the individual devices 15 so that each device 15 can be selected and operated by actuation of the appropriate switch 39. The switches 40 in contrast serve for group control where each switch 40 selects and operates a group of devices 15 ranging for example from two to ten devices 15.

To assist in the understanding of the invention a typical sequence of events will be described. Assume that one of the switches 39, is actuated to apply pressure from the source STP to the conduit connected to the units 29,30 shown in the drawing. This pressure is transmitted through the conduit 35 and the valve 36 to the pressure chamber 34 thereby causing the piston 30 to move against the force of the spring 31 and to extend the piston rod out of the cylinder 29. The cam 32 thus causes the tappet 33 to move inwardly of the valve 25 to overcome the force of the spring 28 to connect the conduits P, 18, 26 to the conduit 24 thereby causing pressure to act on the piston 23. This, in turn, causes the valve 17, in opposition to the force of the spring 19, to assume the state *b* so that the chamber 21 of the device 15 is exposed to pressure via the conduits 18, 22. The piston 16 of the device 15 then moves to expel pressure fluid from the chamber 20 and this pressure fluid passes into the conduit 14 and thence to the chambers 13 to cause the piston rods 12 of the rams 11 to extend by a pre-determined amount, somewhat less than the cutting depth of the mining machine. The switches 39, 40 are so designed that the pressure which is transmitted from the source STP to the unit 29, 30 via a selected one of the conduits ST only prevails for a sufficient time to allow the sequence of events just described to take place. Thereafter the pressure is cut off to the conduit 35 and the pressure in the chamber 34 is able to vent via the throttle device 37 and the valve 38 under the action of the spring 31 which urges the piston 30 inwards. The spring 28 now restores the valve 25 to its former state and the conduit 24 is now connected to the return conduit R to relieve the piston 23. The spring 19 then reverts the valve to the state *a* where the chamber 20 of the device 15 is connected to the conduit P via the conduit 18 and the chamber 21 of the device 15 is connected to the conduit 14 via the conduit 22. The piston 16 thus moves to expel pressure fluid from the chamber 21 to the conduit 14 and thence once again to the chambers 13 thereby causing the piston rods 12 to extend by the predetermined amount again. It can be appreciated that the complete operative cycle initiated by the pressure in one of the conduits ST and terminated with the cessation of this pressure causes the piston rods 12 to extend by two increment. This sequence can be performed a number of times by reactuating the appropriate switch or switches 39, 40 so that the distance by which the piston rods 12 are extended can be accurately controlled.

In a modified system each ram 11 has allocated thereto its own apportioning device 15 so that each ram 11 can be controlled individually or in groups by actuation of one or more of the selection switches 39 or 40. The switches 39, 40 can be operated manually, as already mentioned, or by some remote control. The devices 15 can be of moderate dimensions and hence can be combined with the or one of the associated rams 11 as a constructional unit. Similarly, the valves 17 and 25 and the units 30 can be conveniently embodied in constructional units mounted, for example, on the roof support units.

It is possible to provide some form of stepping mechanism which is allocated to each device 15 or to a group of devices 15. This mechanism can be conveniently mounted on the roof supports and operated via signals generated at a control station. The mechanisms would replace the units 29, 30 so that each mechanism would operate the or each associated valve 25 and hence the valve or valves 17 when a control signal is received. The mechanisms can be designed to provide different numbers of strokes by the or each associated device 15 and provision can be made to also remotely control the desired number of strokes to be performed by the device or devices 15 in question. Thus, each mechanism can be provided with some form of control means initiated by a control signal which enables the valves 17, 25 and devices 15 associated therewith to perform a pre-set number of cycles to thereby cause the rams or rams 11 in question to be extended by a desired amount.

It should be mentioned that in the system illustrated in FIG. 1 and described above, the unit 29, 30 is not strictly essential since it is quite feasible to operate the valve 25 or indeed the valve 17 directly from the designated control conduit ST.

Figure 4:
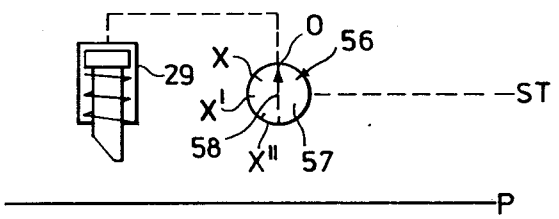
FIG. 4 is a schematic representation of a timing device usable in the system shown in FIG. 1.

FIG. 4 depicts a timing device which can be incorporated in the system shown in FIG. 1. The device, designated 56 is connected to one of the conduits or lines ST and serves to operate the unit 29, 30 (FIG. 1) although it could operate the valve 17 or 25 directly. The device 56 is constructed so that it performs one timing cycle whenever it receives a signal, which can be electrical, hydraulic or pneumatic, from the line ST. To represent this action the device 56 is depicted as having an indicator 58 which moves over a scale 57. When the device 56 receives a first signal the indicator 58 moves to position, *x*, a second signal to position *x'* and so on. Each of these positions *x*, *x'*, *x''* corresponds to a cycle or number of cycles of operation of the associated device 15, and it is convenient to assume that the indicator 58 of the device 56 moves back to its initial neutral position O after the control signal or signals have ended and thereby initiates one or more cycles of operation of the device 15. Hence, if it is desired to make the device 15 perform two cycles of operation then two control signals are transmitted along the line ST. The indicator 58 adopts the position *x'* and then initiates one cycle of operation of the device 15. The indicator 58 next moves to position *x* and a further cycle of operation of the device 15 takes place. Finally, the indicator 58 reverts to the neutral position and is ready to be actuated again by a fresh signal or signals. The device 56 may be a simple clockwork mechanism.

Figure 3:
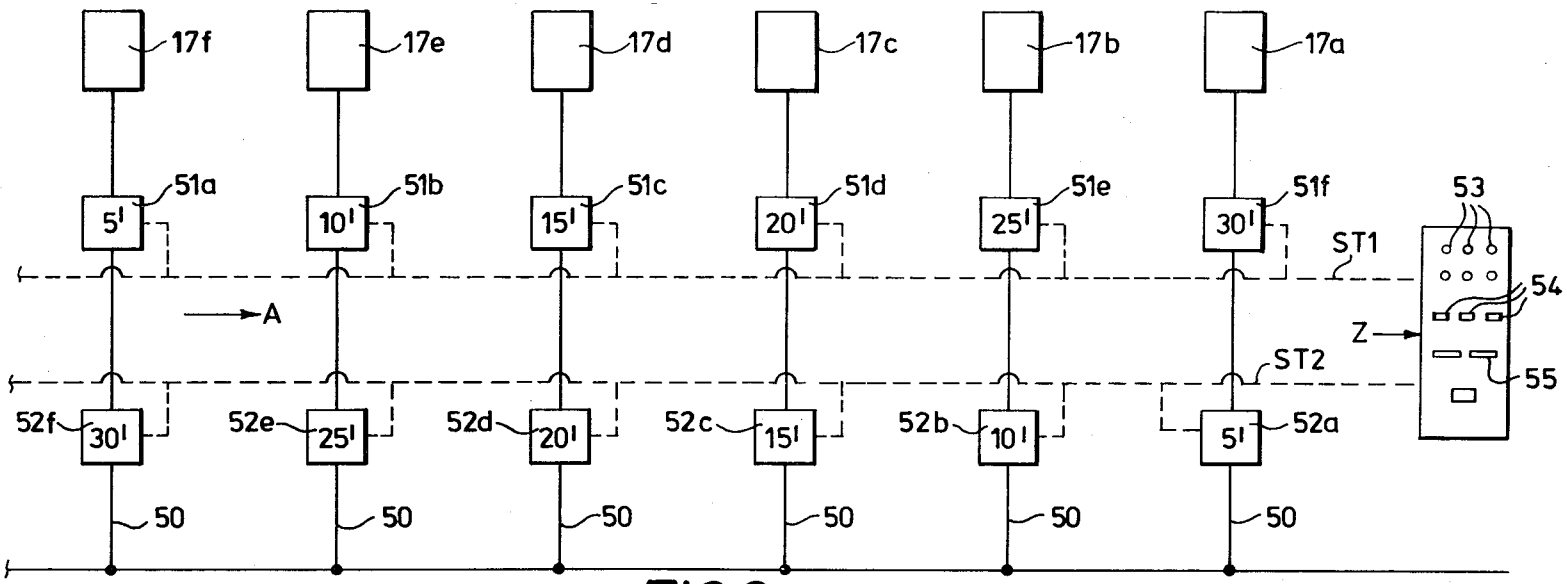
FIG. 3 is a schematic representation of a control arrangement usable in the control system.

The operation of the valves 17 can also be effected by time-controlled valve devices as represented in FIG. 3. There is shown in FIG. 3, a series of valves 17*a* to 17*f*, corresponding to the valve 17 in FIG. 1, which are each connected to a respective one of a series of apportioning devices 15 (not shown). Each valve 17*a* to 17*f* is connected via a conduit 50, corresponding to the conduit 18 in FIG. 1, to the pressure fluid supply conduit P. In each conduit 50 there are time-controlled valve devices 51*a* to 51*f* and 52*a* to 52*f*. The valve devices 51*a* to 51*f* are connected to a control line ST1 and the valve devices 52*a* to 52*f* are connected to a control line ST2. Each valve device 51*a* to 51*f* and 52*a* to 52*f* is composed of a pilot valve which is operated by a timing mechanism to be either open or closed. The timing mechanisms of the valve devices 51*a* to 51*f* and 52*a* to 52*f* are controlled by signals transmitted along the lines ST1 or ST2. In one form of construction the control signals transmitting along the control lines ST1, ST2 are of different duration to effect selection of the valve devices it is desired to open. In the case of the valve devices 51*a* and 51*f* the time setting of the timing mechanisms, which corresponds to the duration of the designating control signals, differs from one device to the next and increases in the direction of arrow A. In a specific case, the time setting for the valve device 51*a* is 5 seconds and this setting increases by 5 second increments in the direction of arrow A so that the delay for the last device 51*f* is 30 seconds. In the case of the valve devices 52*a* to 52*f* the situation is reversed so that the time setting increases in the opposite direction to arrow A with the setting for the device 52*a* being 5 seconds and the setting for the final device 52*f* being 30 seconds. The valve devices with the same suffixes, i.e., *a* to *b* etc., in the groups 51*a* to 51*f* and 52*a* to 52*f* thus have the same time settings.

The control lines ST1, ST2 are connected to a control station Z provided with selector switches 53, 54, 55. By actuating the switches 52–55 to transmit control signals of certain durations and corresponding to the time settings of the valve devices 51*a* to 51*f* and 52*a* and 52*f* selected ones of the devices can be operated to allow pressure fluid to flow from the conduit P to one of the valves 17*a* to 17*f*. Thus to take a specific example if the valve 17*c* is to be connected to the conduit P then the switches 53, 54 55 of the control sation Z are actuated so that a signal of duration 20 seconds is transmitted over the control line ST1 and a signal of duration 15 seconds is transmitted over the control line ST2. The signal on line ST1 causes all the valve devices 51*a* to 51*f* which have a time setting which does not exceed 20 seconds to be actuated so that in this case the valve devices 51*a* to 51*d* inclusive, open. The signal on line ST2 likewise causes all the valve devices 52*a* to 52*f* which have a time setting which does not exceed 15 seconds to be actuated so that in this case the valve devices 52*a* to 52*c* inclusive, open. Thus only in the conduit 50 connected to the valve 17*c* are the two valve devices 51*d, 52c* open and hence the valve 17*c* is subjected to pressure fluid. This valve 17*c* now operates the associated apportioning device 15 to charge the or each pressure chamber 13 of the associated ram or rams 11. If two of the valves 17*a* to 17*f*, say the valves 17*c* and 17*d*, are to be operated simultaneously then a signal of duration 15 seconds is transmitted along the control line ST1 and a signal of duration 25 seconds is transmitted along the control line ST2. The valve devices 51*a* to 51*c* and 52*a* to 52*e* will thus open so that the valves 17*e*, 17*d* are connected through the open valve devices 51*b*, 51*e* and 51*c*, 52*d* to the conduit P.

In general, by actuating the appropriate switches 53–55 at the control station Z the valves 17*a* to 17*f* can be connected, individually or in a group, to the conduit P to thereby cause the associated apportioning device or devices 15 to operate the desired rams or rams 11.

The control signals transmitted over the lines ST1, ST2, can be electrical, hydraulic or pneumatic signals. The time-controlled mechanism of each valve device 51*a* to 51*f* and 52*a* to 52*f* can be constructed to automatically close the pilot valve thereat after it has been open for a predetermined time. Alternatively the pilot valves can be closed after reception of a further control signal transmitted over the control line ST1 or ST2 or after completion of the stroke of the associated apportion device 15. In the latter case the closing signal can be generated by the devices 15 themselves.

Instead of providing control signals of set durations to cause the valve devices 51*a* to 51*f* and 52*a* to 52*f* to open, the timing mechanisms can be triggered by a control signal of short non-critical time duration. In this modified construction the presence of an initiate signal on the line ST1 will cause the timing mechanisms of the valve devices 51*a* to 51*f* to respond and likewise the presence of an initiate signal on the line ST2 will cause the timing mechanisms of the valve devices 52*a* to 52*f* to respond. The timing mechanism of the devices 51*a* to 51*f* and 52*a* to 52*f* will run for the designated setting, i.e., 5 seconds in the case of devices 51*a*, 52*a*, 10 seconds in the case of devices 51*d*, 52*b* and so on. When the timing mechanism of any device 52*a* to 51*f* and 52*a* to 52*f* has run for its complete setting time the associated pilot valve will be opened. Thus, after an initiation signal and the valve devices 51*a* to 51*f* will open in succession at intervals of 5 seconds. The opening of the pilot valves of the devices 51*a* to 51*f* and 52*a* to 52*f* will however be over-ridden by the transmission of a stop signal along the line ST1 or ST2 which will cause the timing mechanism of the devices which are still closed to revert to their former state. Thus, to take a specific example, if the valve 17*d* is to be operated, an initiate signal is transmitted along each of the lines ST1, ST2 so that all the timing mechanism of the devices 51*a* to 51*f* and 52*a* to 52*f* will respond and in the absence of stop signals, the mechanisms will open their respective pilot valves at intervals of 5 seconds, 10 seconds, etc., respectively. A stop signal is however transmitted along one line ST1 after 15 seconds have elapsed. As a result the pilot valve of the devices 51*a* to 51*c* will already be open and will remain open whereas the timing mechanisms of the devices 51*d* to 51*f* will revert to their initial state and their pilot valves will remain closed. Likewise, a stop signal is transmitted along the line ST2 after 20 seconds have elapsed. As a result of this the pilot valves of the devices 52*a* to 52*d* will be open and will remain open whereas the timing mechanisms of the devices 52*e* and 52*f* will revert to their initial state and their pilot valves will remain closed. It will be appreciated that only the valve devices 51*c*, 52*d* provide a path for pressure fluid and that only the valve 17*d* is connected thereby to the conduit P. As before the pilot valves of the devices which are open can be closed again automatically by their mechanisms after a certain time has elapsed or upon reception of a further control signal as described above. In a manner analogous to that previously described the devices 15 and hence the rams 11 can be controlled individually or in groups according to a time sequence which can be generated automatically by the control station Z.

Although the arrangement depicted in FIG. 3 is shown as directly controlling the valves 17*a* to 17*f* it is possible to control the valves 25 or the units 29, 30 in the system shown in FIG. 1. Also the principle involved in the arrangement shown in FIG. 3 may be useful in other applications.

Figure 5:
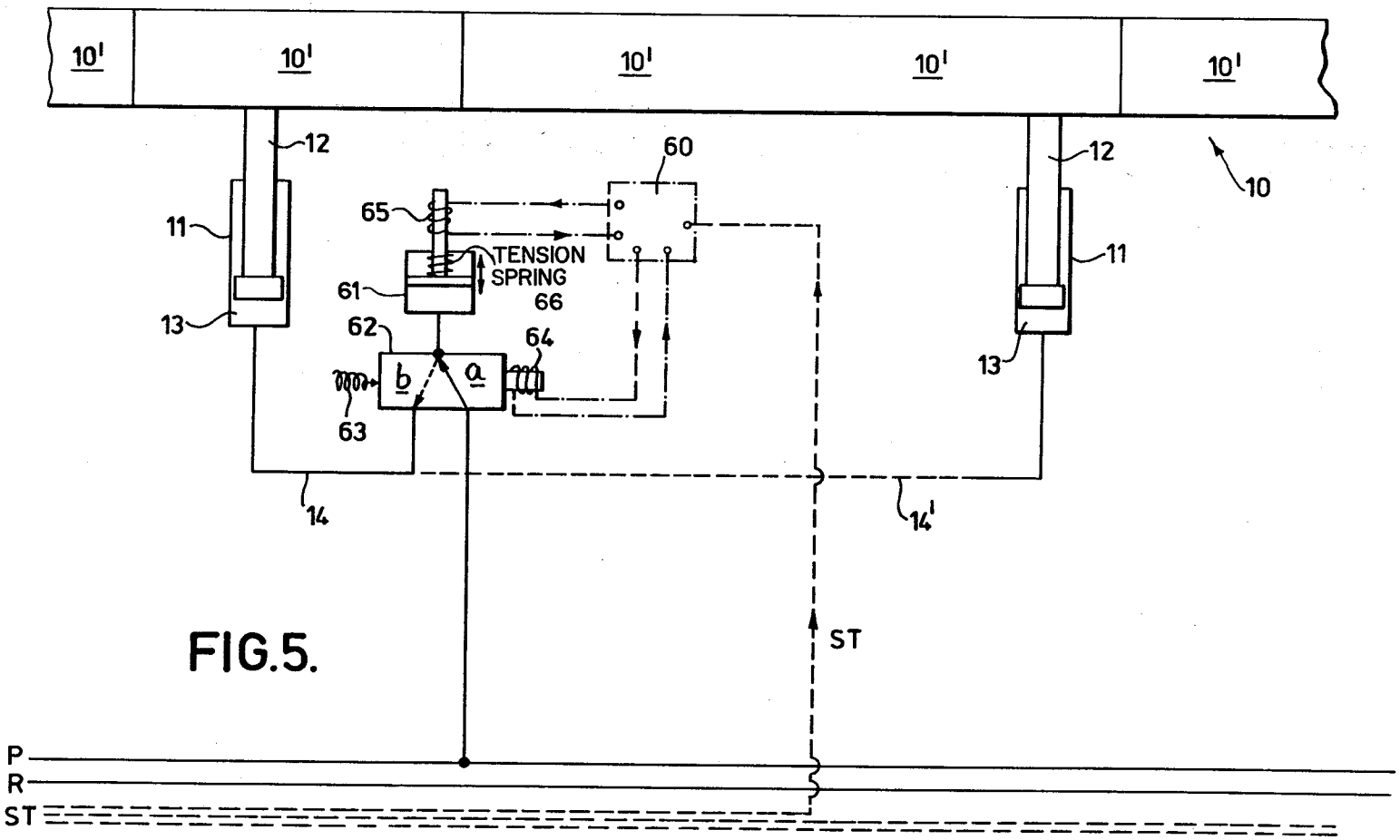
FIG. 5 is a block schematic diagram depicting another control arrangement.

The arrangement depicted in FIG. 5 employs a two-way hydrualic connecting valve 62 capable of adopting either a connecting state *a* or a connecting state *b*. The valve 62 has an inlet port connected to the pressure fluid supply line P and an outlet port connected to the working chamber 13 of the associated shifting ram 11 via a line 14. A spring 63 biases the valve 62 into state *a* where the inlet port is connected to the single working chamber of a piston and cylinder device 61. The piston of the device 61 is subjected to the action of a biasing means, here embodied as a tension spring 66, so that with the valve 62 in its state *a* the chamber of the device 61 accepts pressure fluid. The piston rod of the device 61 is provided with an electromagnetic solenoid 65 which, when energized, displaces the piston against the restoring force of the spring 66 to expel the fluid in the working chamber. The valve 62 has a control piston which is also provided with an electromagnetic solenoid 64 which, when energized, changes the valve 62 to state *b* against the restoring force of the spring 63. Both solenoids 64, 65 are connected to a control unit 60 which provides actuating energizing pulse(s) thereto in response to control signals ST. In operation several signals St will cause a repetitive control action each of which commences with the device 61 storing fluid in its working chamber. The solenoids 64, 65 next actuate their respective valve 62 and device 61 to cause the piston of the device 61 to expel a small predetermined dose of fluid through the valve 62 and into the chamber 13. The cessation of the energizing pulses for the solenoids 64, 65 will allow the springs 66, 63 to restore the initial condition causing the device 61 to again draw in and store fluid.

The control unit 60 may successively energize the solenoids 64, 65 either in direct dependence on the signals ST or else in indirect dependence of the signals ST. In the former case, for example, six successive signals ST produce six solenoid pulses and hence six successive doses of fluid fed to the ram 11. In the latter case a coded, e.g. binary or timing, signal ST would trigger the unit 60 to automatically cycle the valve 62 and the device 61 a set number of times corresponding to the information imparted by the signal ST. The arrangement as illustrated may be provided for each ram 11 in a longwall working or else several rams 11 may be fed in common by one arrangement as represented by the dotted line 14'. A preferred construction would however have a single control unit 60 located remotely and connected to the solenoids 64,65 of a plurality of arrangements 61, 62 each located locally and conveniently physically coupled to a respective one of the rams 11. This preferred location for the unit 60 is represented by the chain dotted outline in FIG. 5.

Figure 6:
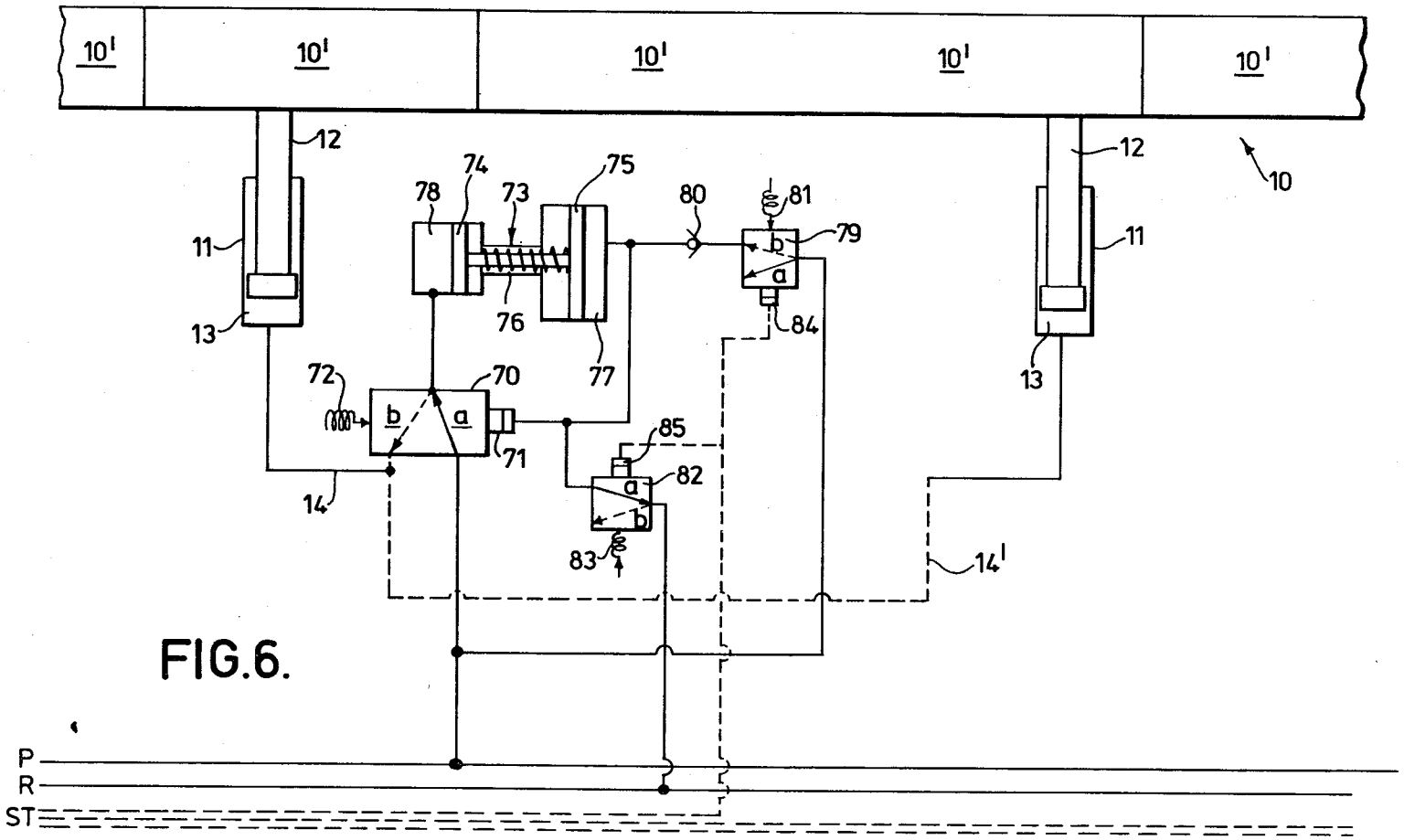
FIG. 6 is a block schematic diagram depicting a further control arrangement.

The arrangement depicted in FIG. 6 also employs a two way hydraulic connecting valve 70 capable of adopting either a connecting state or *a* or a connecting state *b*. The valve 70 has an inlet port connected to the pressure fluid supply line P and an outlet port connected to the working chamber 13 of an associated shifting ram 11. A spring 72 biases the valve into state *a* where the inlet port is connected to a first working chamber 78 of a piston and cylinder device 73. This device 73 employs first and second differential pistons 74, 75; the smaller piston 74 being associated with the working chamber 78 and the larger piston 75 being associated with a second chamber 77. A spring 76 acts on the piston 75 or otherwise to bias the pistons to the right-hand side of FIG. 6 thereby causing the chamber 78 to be charged with pressure fluid with the valve 70 in the state *a* as shown. The second chamber 77 of the device 73 and a control piston 71 of the valve 70 are connected through a non-return valve 80 to the outlet port of a control valve 79. This valve 79 has an inlet port connected to the supply line P and is capable of adopting either state *a* or state *b*. A spring 81 biases the valve 79 to state *a* where the inlet and outlet ports are isolated. A further connecting valve 82 has an inlet port connected to the second chamber 77 of the device 73 and an outlet port connected to the pressure fluid return line R. The valve 82 is also capable of adopting either a state *a* or a state *b*. A spring 83 biases the valve 82 to state *a* where the inlet and outlet ports are interconnected to exhaust the chamber 77. Both valves 79, 82 have control pistons 84, 85 here connected directly to receive pressure control signals ST preferably of pneumatic nature. As before, several signals ST in succession will cause a repetitive control action each commencing with the chamber 78 of the device 73 storing fluid. The next occuring signal ST will trip the valves 79, 82 to state *b* so that pressure fluid will act on the piston 75 in opposition to the spring 76 to cause the piston 74 to expel a small predetermined dose of fluid through the valve 70 set to state *b* by the fluid acting on the piston 71. The cessation of the signal ST will allow the springs 72, 81, 83 to restore the valves 70, 79, 82 to state *a* to thereby allow the spring 76 to move the pistons 74, 75 to displace fluid from the chamber 77 and to draw in fluid into the chamber 78 ready for the next cycle.

Successive signals ST can thus cause a desired accumulative quantity of fluid to charge the ram 11. The arrangement as described can be provided for each ram 11 or alternatively several rams can be fed in common by one arrangement as represented by the chain dotted line 14' in FIG. 6.

Figure 7:
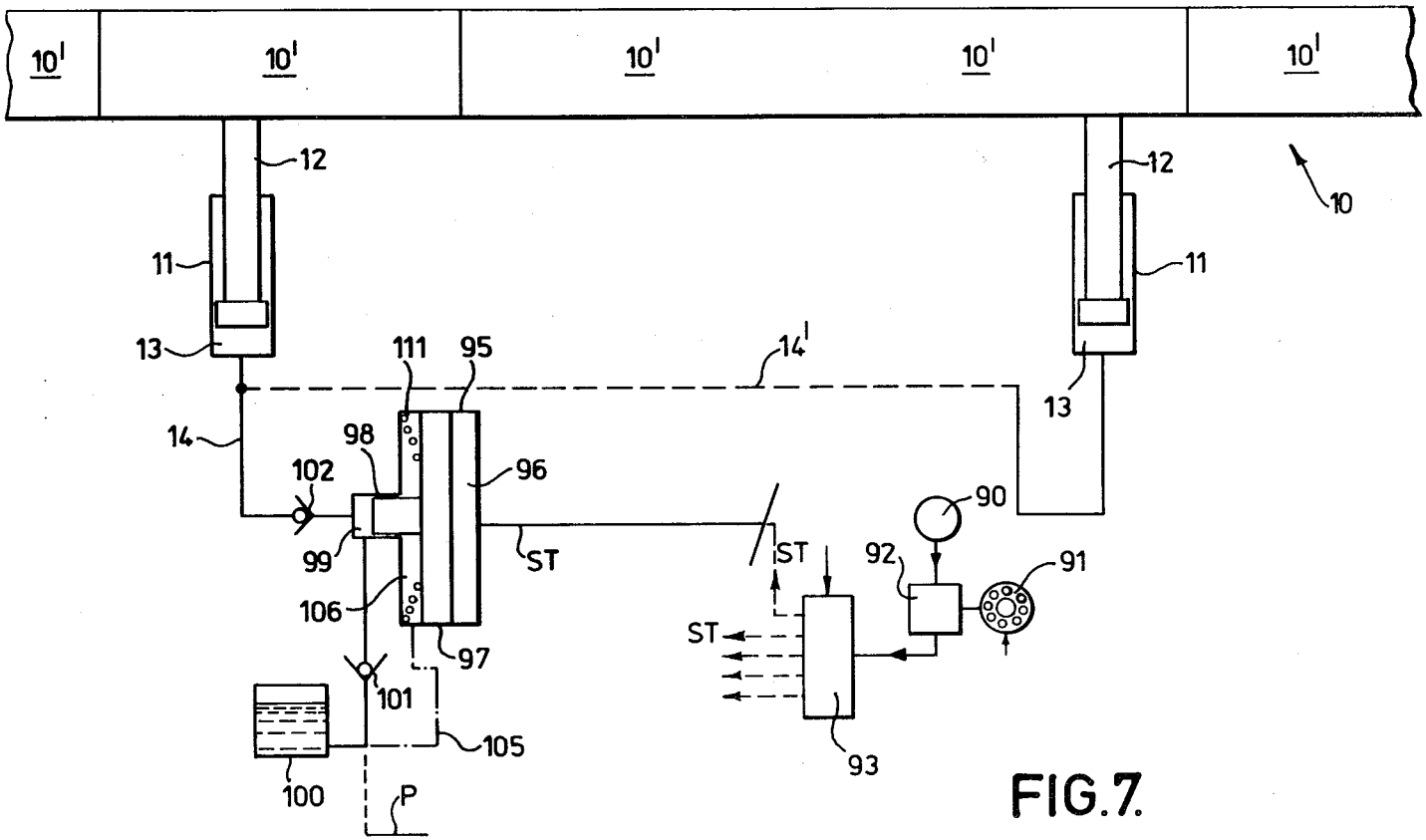
FIG. 7 is a block schematic diagram depicting a further control arrangement.

Finally, in the arrangement depicted in FIG. 7, a piston and cylinder device or dosing appliance 95 is allocated to one or several (as represented by the dotted line 14') rams 11. The device 95 has first and second differential pistons 97, 98 with respective chambers 96, 99. The main working chamber 99 is connected through a non-return valve 101 to a source of pressure fluid 100 or the pressure supply line P of the previous embodiments on the one hand and through a non-return valve 102 to the working chamber 13 of the ram(s) 11, via a line 14 (14'). The pistons 97, 98 are biased to the right hand side of FIG. 7 with the aid of a spring 111 to thereby cause fluid to be drawn into the chamber 99. Apparatus for providing control signals comprises a rotatable disc 91 which can be indexed to initiate a pre-determined number of pulses or signals ST.

The pulses or signals are derived here from a source of compressed air 90 operating in conjunction with a timing or cycling device 92. These source signals are routed to a desired device 95 with the aid of a selector 93 via lines 94 to provide the local signals ST. During operation, the device 95 stores fluid in the chamber 99 until a pressure pulse signal ST enters the chamber 96 to displace the pistons 98, 97 against the force of the spring 111 thereby expelling a small predetermined dose of fluid fed to the chamber 13 of the ram 11. When the prevailing signal ST ceases the spring 111 restores the pistons 97, 98 to their initial position thereby charging the chamber 99 afresh with fluid. A succession of signals ST can thus cause a corresponding succession of fluid doses to be fed to the ram or rams 11 in question.

If the source 100 is at relatively low pressure the biasing spring 111 can be omitted and connection indicated at 105 can be established between the source 100 and a working chamber 106 at the rear face of the piston 97.

I claim:

1. In a mineral mining installation with a plurality of shifting rams arranged in a mine working and serving to displace mining apparatus through a predetermined distance, each shifting ram having a working chamber which is charged with pressure fluid to extend the shifting ram; an improved control system for operating the shifting rams and effecting fine control of the displacement of the mining apparatus, said system comprising: pressure fluid supply means for supplying pressure fluid used for operating the shifting rams; and a plurality of fluid-apportioning devices each allocated to at least one of the shifting rams, each apportioning device including a piston and cylinder unit having a piston and having a single working chamber located solely on one side of the piston, mechanical means for biasing the piston in the direction which increases the volume of the single working chamber, automatic means for alternately and cyclically connecting the pressure fluid supply means to the single working chamber of the piston and cylinder unit, and connecting the working chamber of the at least one shifting ram solely to the single working chamber of the piston and cylinder unit, means for cyclically operating the piston of the piston and cylinder unit to alternately permit the single working chamber of the piston and cylinder unit to be charged with pressure fluid and to expel the pressure fluid to the working chamber of the associated shifting ram in predetermined non-variable quantities in successive doses, each dose corresponding to the expelling displacement of the piston of the piston and cylinder unit and to a single connecting cycle of the connecting means, and means for generating and transmitting separate control signals for causing the operating means and the connecting means to cooperatively transfer a succession of fluid doses to the associated shifting ram, thereby moving the mining apparatus through a fraction of the predetermined distance.

2. An installation according to claim 1, wherein each apportioning device is operably connected to two or more rams.

3. An installation according to claim 1, wherein the control signals are pressure signals.

4. An installation according to claim 1, wherein the control signals are electric signals.

5. An installation according to claim 1, wherein the connecting means is in the form on a two-way valve which is spring biased to connect the single working chamber of the piston and cylinder unit to the pressure fluid supply means and wherein the control signal means produces electric pulses actuating the connecting means to change the state of said two-way valve to connect the single working chamber of the unit to the working chamber of the shifting ram and also to permit the expelling displacement of the piston of the unit.

6. An installation according to claim 5, wherein the piston of the piston and cylinder unit is spring biased to a position whereat charging of the single working chamber thereof occurs.

7. An installation according to claim 6, wherein the electric pulses energize electromagnetic means effecting the change of state of the two-way valve and the expelling displacement of the piston of the piston and cylinder unit against the restoring forces of the spring bias.

8. An installation according to claim 1, wherein the connecting means includes a two-way valve which is spring biased to connect the single working chamber of the piston and cylinder unit to the pressure fluid supply means, and wherein the control signal means produces pressure pulses actuating the connecting means to change the state of said two-way valve to connect the single working chamber of the unit to the working chamber of the shifting ram and also to permit the expelling displacement of the piston of the unit.

9. An installation according to claim 8, wherein the piston and cylinder unit has an additional piston fixed to the other side of the first-mentioned piston, wherein the piston and cylinder unit has a second chamber in which said additional piston travels, and wherein the second chamber receives pressure pulses which act upon said additional piston.

10. An installation according to claim 9, wherein the additional piston has a larger working area than that of the first-mentioned piston, and the pistons are spring-biased to a position whereat charging of the single working chamber occurs.

11. An installation according to claim 10, wherein the two-way valve has a control piston subjected to said pressure pulses, further including a second two-way valve which is spring biased to isolate the pressure fluid supply means from the additional piston of the piston and cylinder unit and from the control piston of the first-mentioned two-way valve, and wherein the control signals serve to change the state of the second two-way valve to connect the additional piston and the control piston to the pressure fluid supply means.

12. An installation according to claim 11, further including a third two-way valve which is spring biased to connect the control piston and the additional piston to a pressure fluid return path, and wherein the control signals also serve to change the state of the third two-way valve to isolate the return path from the control piston and additional piston when the second valve changes state.

* * * * *